US006502761B1

(12) United States Patent
Pace et al.

(10) Patent No.: US 6,502,761 B1
(45) Date of Patent: Jan. 7, 2003

(54) WALL EFFECT INJECTOR SEAT

(75) Inventors: Jeff Pace, Newport News, VA (US); Vernon Warner, Wicomico, VA (US); John F. Nally, Jr., Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 38 days.

(21) Appl. No.: 09/628,947

(22) Filed: Jul. 28, 2000

(51) Int. Cl.[7] ..... F02D 7/00; F02M 61/00

(52) U.S. Cl. ..... 239/5; 239/533.2; 239/533.12; 239/533.14; 239/596; 239/585.1

(58) Field of Search ..... 239/533.2, 533.12, 239/533.14, 596, 5, 585.1, 585.2, 585.3, 585.4, 585.5

(56) References Cited

U.S. PATENT DOCUMENTS 4,057,190 A * 11/1977 Kiwior et al. ..... 239/533.12 X
5,285,970 A * 2/1994 Maier et al. ..... 239/533.12
5,484,108 A * 1/1996 Nally ..... 239/585.4 X
6,089,476 A * 7/2000 Sugimoto et al. ... 239/533.12 X
6,102,299 A * 8/2000 Pace et al. ..... 239/5

FOREIGN PATENT DOCUMENTS

JP 2-50010 * 2/1990 ..... 239/533.12

* cited by examiner

*Primary Examiner*—Robin O. Evans

(57) ABSTRACT

A fuel injector is disclosed. The fuel injector has an upstream end, a downstream end, and a longitudinal axis extending therethrough. The fuel injector also has a body and a cylindrical needle. The needle is reciprocably located within the body between an open configuration adapted for permitting delivery of fuel from the downstream end and a closed configuration adapted for preventing delivery of the fuel from the downstream end. The fuel injector further includes a seat disposed proximate the downstream end. The seat includes a sealing surface engageable with the needle when the needle is in the closed configuration. The sealing surface has a seating diameter. The seat also includes a seat opening extending therethrough along the longitudinal axis. The seat opening has an opening diameter such that a ratio between the opening diameter and the seating diameter is less than 0.6. A method of generating turbulent flow in a fuel injector is also provided.

12 Claims, 8 Drawing Sheets

TABLE 1

| Injector # | Wall Effect | Static Flow [g/s] | Dynamic flow [mg/P] | SMD [μm] |
|---|---|---|---|---|
| 1 | No | 4.439 | 7.511 | 364.42 |
| 2 | No | 4.462 | 7.558 | 325.85 |
| 3 | Yes | 4.117 | 7.461 | 236.54 |
| 4 | Yes | 3.793 | 7.403 | 203.81 |

Fig. 5

WALL EFFECT INJECTOR SEAT

FIELD OF INVENTION

This invention relates to fuel injectors in general, and more particularly to fuel injector assembly which includes a modified seat for enhanced fuel atomization for maximizing fuel combustion.

BACKGROUND OF INVENTION

In internal combustion engines having direct injection systems, fuel injectors are conventionally used to provide a precise amount of fuel needed for combustion. The fuel injector is required to deliver the precise amount of fuel per injection pulse and maintain this accuracy over the life of the injector. In order to optimize the combustion of fuel, certain strategies are required in the design of fuel injectors. These strategies are keyed to the delivery of fuel into the intake manifold of the internal combustion engine in precise amounts and flow patterns. Known prior fuel injector designs have failed to optimize the combustion of fuel injected into the intake manifold of an internal combustion engine.

One way to optimize the combustion of the fuel is to provide the fuel to the intake manifold of the engine in a great multitude of small, atomized droplets. Such atomized droplets increase the surface area of the fuel being injected, affording a more homogeneous mixture of the fuel with the combustion air. A more homogeneous fuel/air mixture provides more even combustion and improves the fuel efficiency of the engine. One method of producing desired atomized fuel droplets is to generate turbulence in the fuel flow during injection. It would be beneficial to provide a fuel injector which generates an increased amount of turbulence in the fuel flow during injection as compared to previously known fuel injectors.

BRIEF SUMMARY OF THE INVENTION

Briefly, the present invention provides a fuel injector comprising an upstream end, a downstream end, and a longitudinal axis extending therethrough. The fuel injector also has a body and a cylindrical needle. The needle is reciprocably located within the body between an open configuration adapted for permitting delivery of fuel from the downstream end and a closed configuration adapted for preventing delivery of the fuel from the downstream end. The fuel injector further includes a seat disposed proximate the downstream end. The seat includes a sealing surface engageable with the needle when the needle is in the closed configuration. The sealing surface has a seating diameter. The seat also includes a seat opening extending therethrough along the longitudinal axis. The seat opening has an opening diameter such that a ratio between the opening diameter and the seating diameter is less than 0.6.

Additionally, the present invention provides provides a fuel injector comprising an upstream end, a downstream end, and a longitudinal axis extending therethrough. The fuel injector also has a body and a cylindrical needle. The needle is reciprocably disposed within the body between an open configuration adapted for permitting delivery of fuel from the downstream end and a closed configuration adapted for preventing delivery of the fuel from the downstream end. The fuel injector also has a seat disposed proximate the downstream end. The seat includes a seating surface engageable with the needle when the needle is in the closed configuration. The seating surface has a seating diameter. The seat also has a seat opening extending therethrough along the longitudinal axis. The fuel injector also includes a metering plate located downstream of the seat. The metering plate has at least one metering opening spaced from the longitudinal axis a distance greater than half of the opening diameter.

The present invention also provides a method of generating turbulent flow in a fuel injector. The method comprises providing a fuel injector having a longitudinal axis extending therethrough and a needle located along the longitudinal axis. The fuel injector also includes a seat having a seating diameter and a seat opening downstream of the seating diameter and along the longitudinal axis such that the needle engages the seat at the seating diameter in a closed position. The fuel injector also comprises a metering plate located downstream of the seat. The metering plate has at least one metering opening spaced from the longitudinal axis a distance greater than half of the opening diameter. The method also comprises providing fuel through the injector.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

FIG. 5 is a Table showing flow and spray characteristics of injectors with and without a wall effect;

DETAILED DESCRIPTION OF THE PREFERRED EMBODIMENTS

Figure 1:
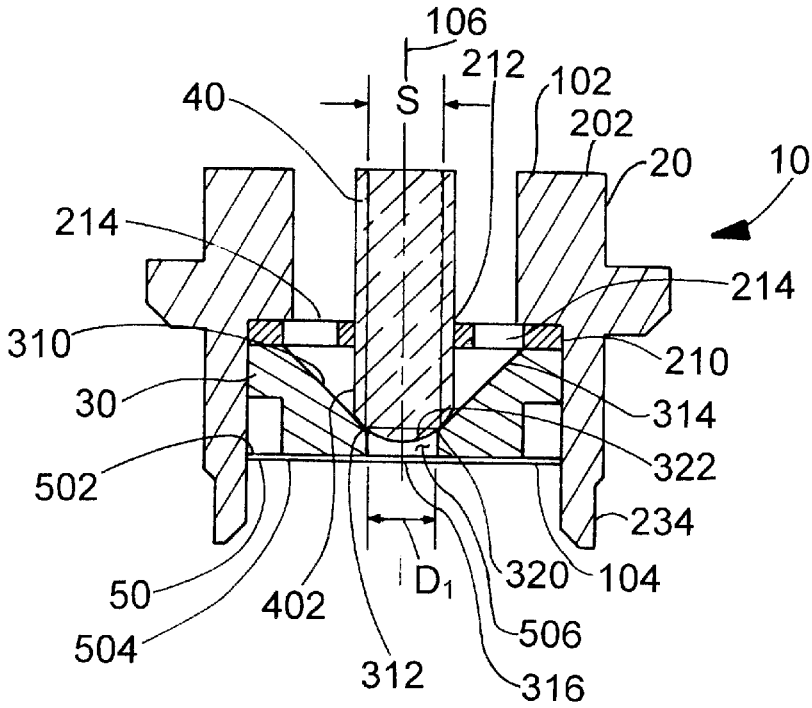
FIG. 1 is a side profile view, in section, of a discharge end of a first version of a fuel injector of the present invention taken along its longitudinal axis.

FIG. 1 shows a sectional view of the discharge end of a fuel injector 10 according to a first embodiment of the present invention. In the drawings, like numerals are used to indicate like elements throughout. The remaining structure of the fuel injector 10 will be omitted as the general structure and configuration of fuel injectors is well known to those skilled in the art, and is not necessary to understand the present invention. A fuel injector in which the present invention can be applied is disclosed in U.S. Pat. No. 5,462,231, which is owned by the assignee of the present invention and is incorporated herein in its entirety by reference.

The fuel injector 10 has an upstream end 102, a downstream end 104, and a longitudinal axis 106 extending therethrough. The fuel injector 10 includes a generally annular body 20, a seat 30, a generally cylindrical needle 40, and an outlet orifice 50. The body 20 has an upstream end 202 and a downstream end 204. A needle guide 210 is located within the body 20 and guides a discharge end 402 of the needle 40 during operation. The needle guide 210 includes a guide opening 212 located along the longitudinal axis 106 through which the needle 40 extends. Preferably, the guide 210 also includes a plurality of fuel flow openings 214 extending therethrough around a perimeter of the needle 40. The fuel flow openings 214 allow fuel to flow from the upstream end 102 to the downstream end 104 for injection into the combustion chamber of an internal combustion engine (not shown).

The seat 30 is located within the body 20, downstream of the guide 210. The seat includes a beveled annular seating surface 310 and a seat opening 320. The seating surface 310 includes a generally annular seating diameter 312 which engages the needle 40 when the injector 10 is in a closed position.

Preferably, the seating surface 310 has a generally constant flat taper which extends from an upstream end 314 generally inward to a downstream end 316. However, those skilled in the art will recognize that the seating surface 310 can have profiles other than a constant flat taper, as long as the downstream end 316 is closer to the longitudinal axis 106 than the upstream end 314. The seating diameter of the needle 40 with the seat 30 is preferably 1.67 millimeters in size and is denoted by "S". The seat opening 320 is located along the longitudinal axis 106 and includes a generally cylindrical wall 322 which is generally parallel to the longitudinal axis 106. The diameter of the seat opening 320 is denoted by "$D_1$". The needle 40 is reciprocably located within the body 20 between an open configuration adapted for permitting delivery of fuel through the seat opening 320 and a closed configuration adapted for preventing delivery of the fuel through the seat opening 320.

The orifice 50 has an upstream surface 502, a downstream surface 504, and an orifice opening 506 extending longitudinally therethrough. For an orifice 50 having a single orifice opening 506, the orifice opening 506 is preferably along the longitudinal axis 106.

Figure 2:
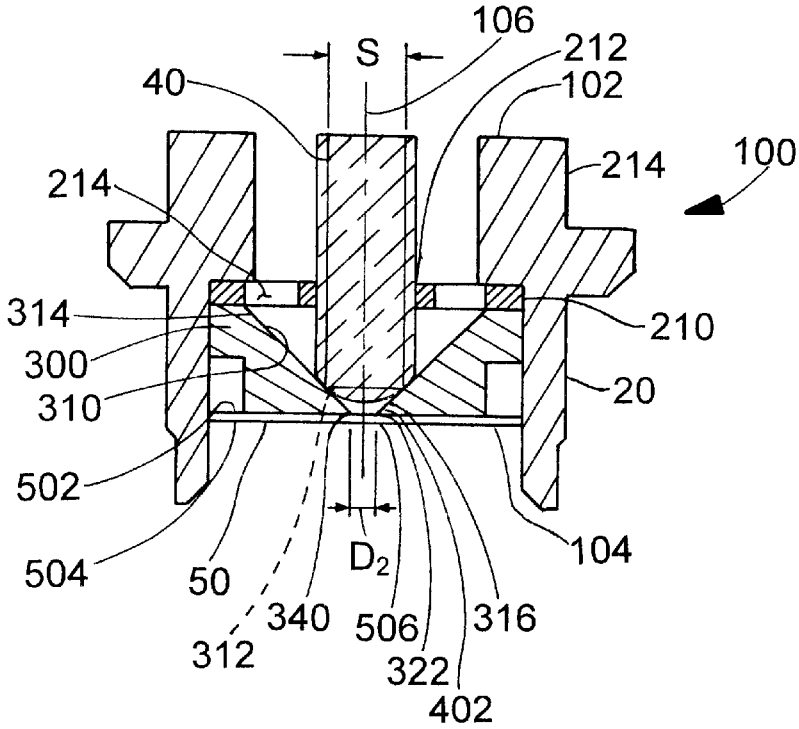
FIG. 2 is a side profile view, in section, of a discharge end of a second version of the fuel injector according to the first embodiment of the present invention.

FIG. 2 shows a second version of a fuel injector 100, which is similar to the fuel injector 10 of FIG. 1, but with a seat 300 having a seat opening 340 with a seat opening diameter $D_2$. Comparison of FIG. 1 with FIG. 2 shows that $D_2$ is significantly smaller than $D_1$. For a fixed mass flow $\dot{m}$ of fuel through the injector 10 during operation, the mass flow rate equation is:

$$\dot{m}=\rho v A \qquad \text{Equation 1}$$

where $\dot{m}$ is the mass flow rate;

$\rho$ is the fluid density;

v is the average fluid velocity; and

A is the area, which, for a circular area, is defined by:

$$A=(\pi D^2)/4 \qquad \text{Equation 2}$$

If the cross-sectional area $A_1$ of the seat opening 320 shown in FIG. 1 is reduced by half to a reduced cross-sectional area $A_2$ of the seat opening 340 shown in FIG. 2, then:

$$A_2=\tfrac{1}{2}(A_1). \qquad \text{Equation 3}$$

At a constant mass flow rate m, $$\dot{m}_1=\dot{m}_2. \qquad \text{Equation 4}$$

Substituting for $\dot{m}$ from equation 1, $$\rho v_1 A_1=\rho v_2 A_2. \qquad \text{Equation 5}$$

and $$v_1 D_1^2=v_2 D_2^2. \qquad \text{Equation 6}$$

Solving for $v_2$ yields:

$$v_2=v_1 x(D_1^2/D_2^2) \qquad \text{Equation 7}$$

Since $D_1$ is larger than $D_2$, $v_2$ is larger than $v_1$, resulting in an increase in the velocity of the fuel through the seat opening 340 as compared to the velocity of the fuel through the seat opening 320.

The Reynolds number (Re) is defined as:

$$Re=vD/\upsilon \qquad \text{Equation 8}$$

where:

v=average fluid velocity;

D=seat opening diameter $\upsilon$=kinematic viscosity

For $D_2=\tfrac{1}{2}D_1$, substitution of terms in Equations 6 and 8 yields the equation:

$$Re_2=2Re_1. \qquad \text{Equation 9}$$

Therefore, for constant mass flow $\dot{m}$, a decrease in the diameter of the seat opening from $D_1$ to $D_2$ results in an increased Reynolds number. Increasing the Reynolds number promotes turbulence within the fuel flow in a shorter flow distance, which leads to flow instability and break up, resulting in increased atomization of the fuel prior to the orifice 50. Preferably, a Reynolds number of at least 13,000 is desired. To obtain this preferred Reynolds number, the mass flow velocity of fuel through the injector 10 at the upstream surface 502 of the orifice 50 is preferably between 3.7 and 4.1 g/s and the diameter $D_2$ of the seat opening 340 is between 0.99 and 1.01 microns. Also preferably, the seating diameter S of the needle 40 with the seat 30 is between 1.66 and 1.68 microns, yielding a ratio of the diameter $D_2$ of the seat opening 340 to the seating diameter S of between 0.59 and 0.60.

Figure 3:
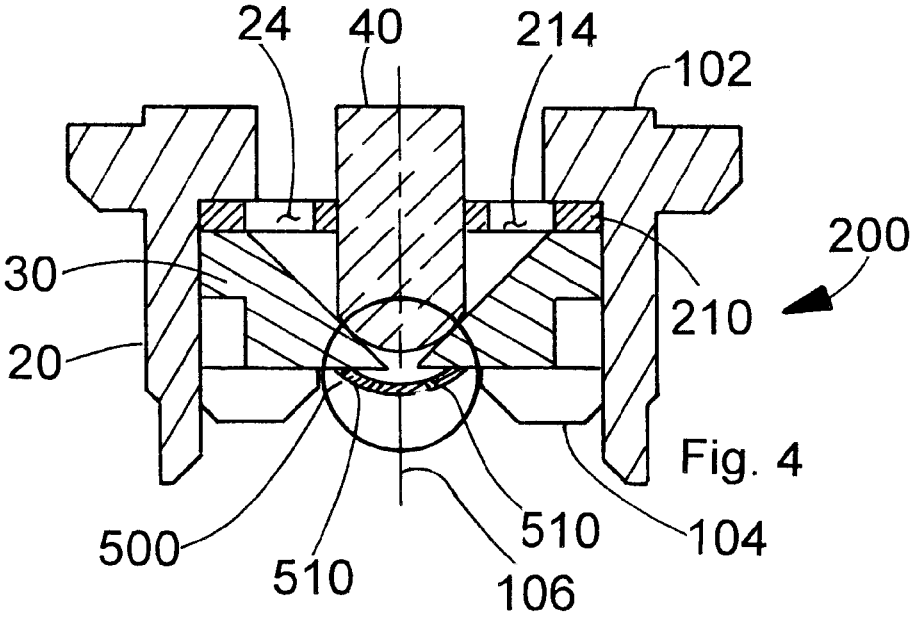
FIG. 3 is a side profile view, in section, of a discharge end of a second embodiment of the fuel injector according to the present invention taken along its longitudinal axis.
Figure 4:
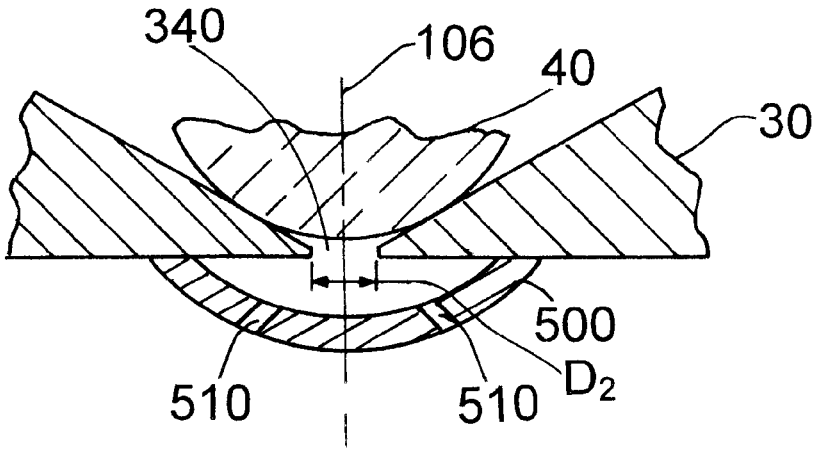
FIG. 4 is an enlarged view of the seat opening area shown in FIG. 3.
Figure 6A:
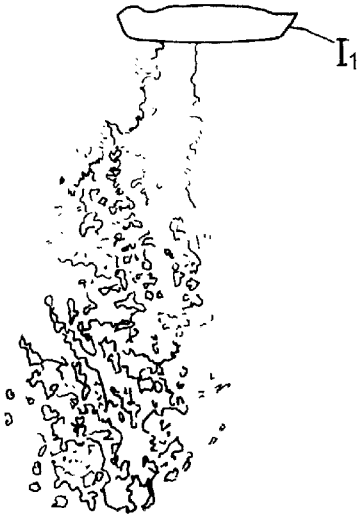
FIGS. 6A–D are spray pattern image results for the spray pattern measurements of Table 1 in FIG. 5.
Figure 6C:
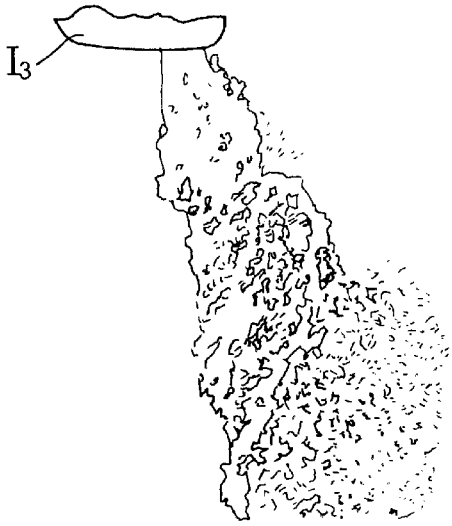
Figure 6B:
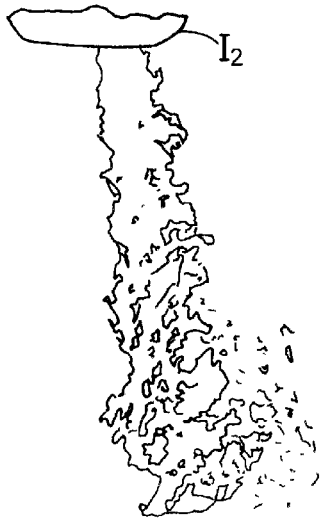
Figure 6D:
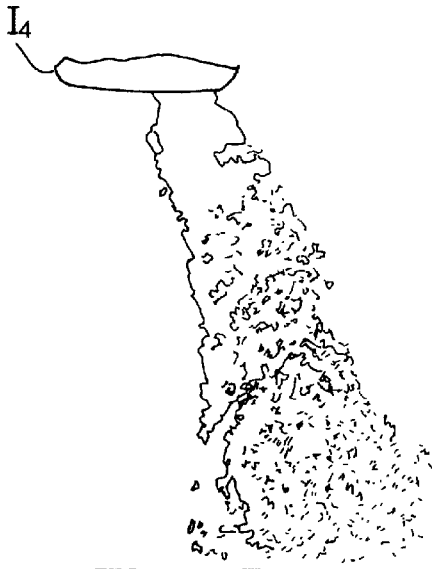
Figure 7A:
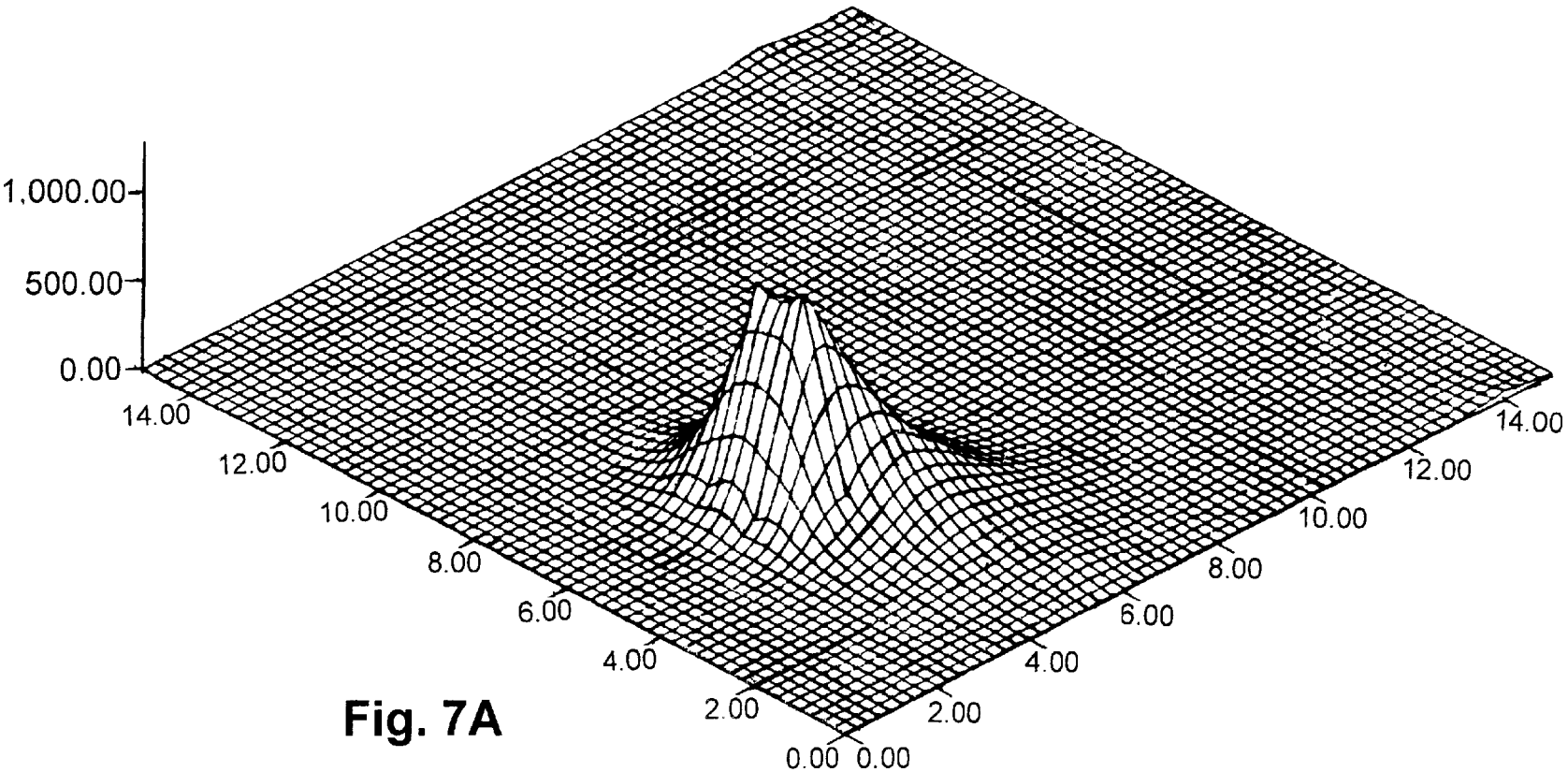
FIGS. 7A–D are three-dimensional spray pattern image results for the spray pattern measurements of Table 1 in FIG. 5.
Figure 7B:
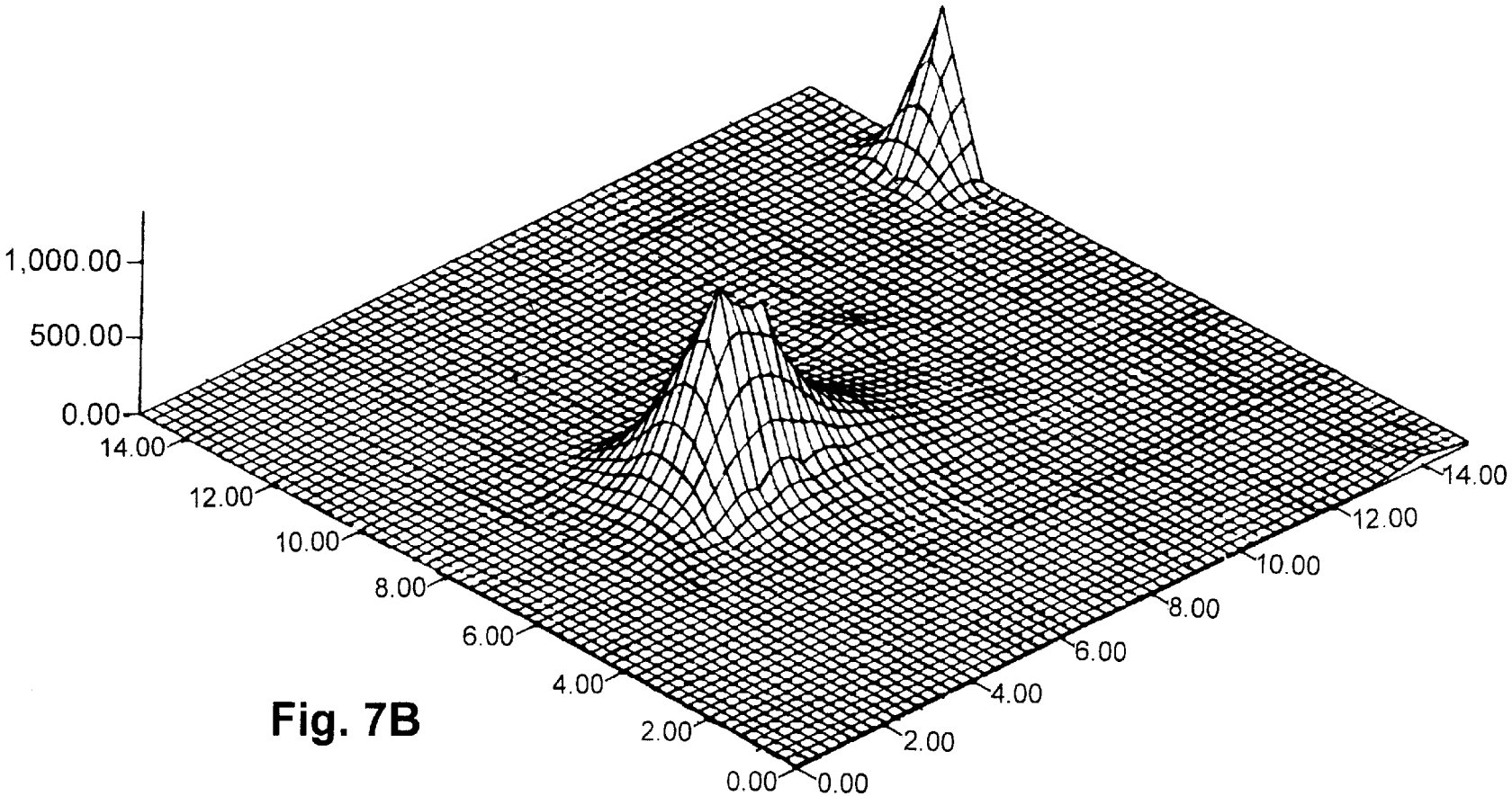
Figure 7C:
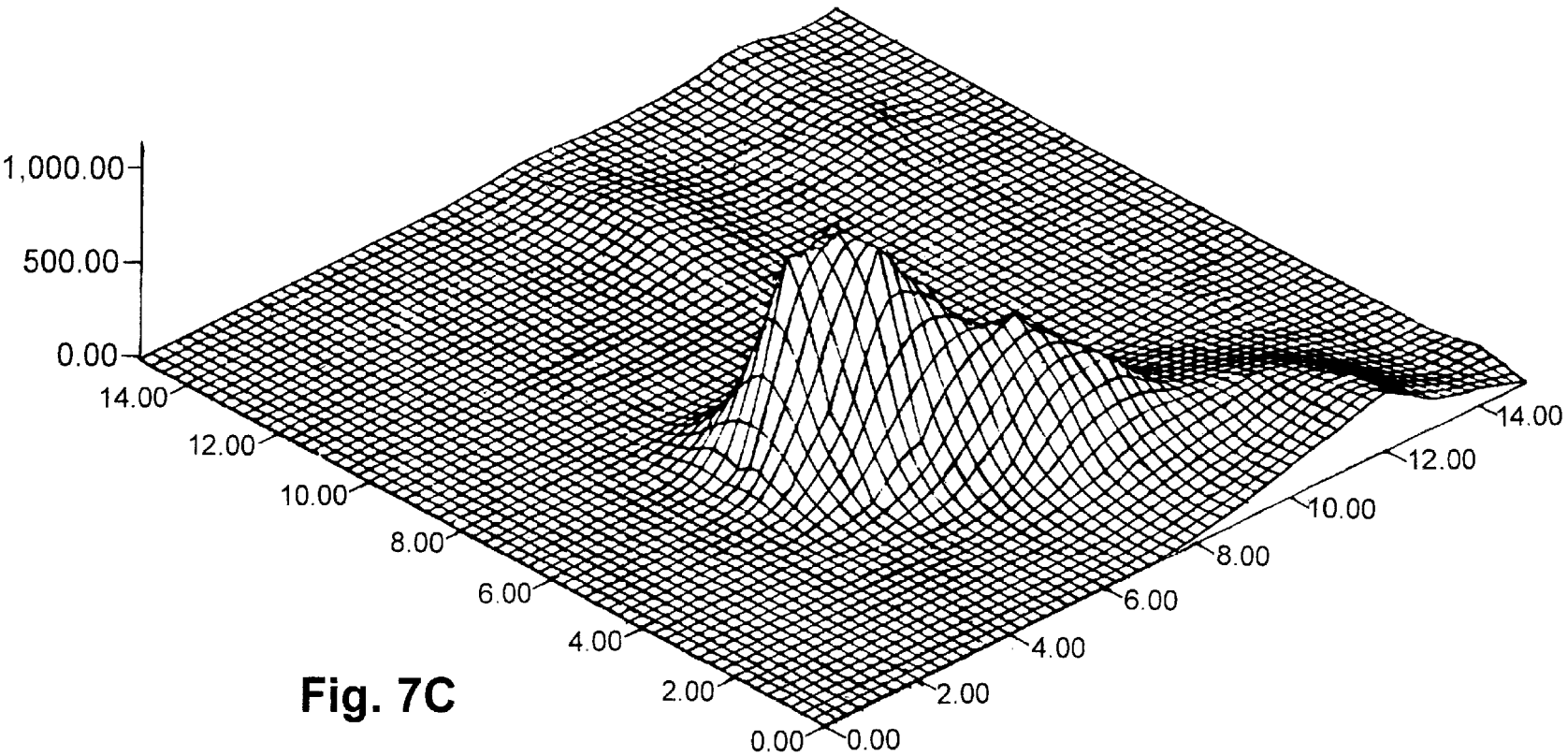
Figure 7D:
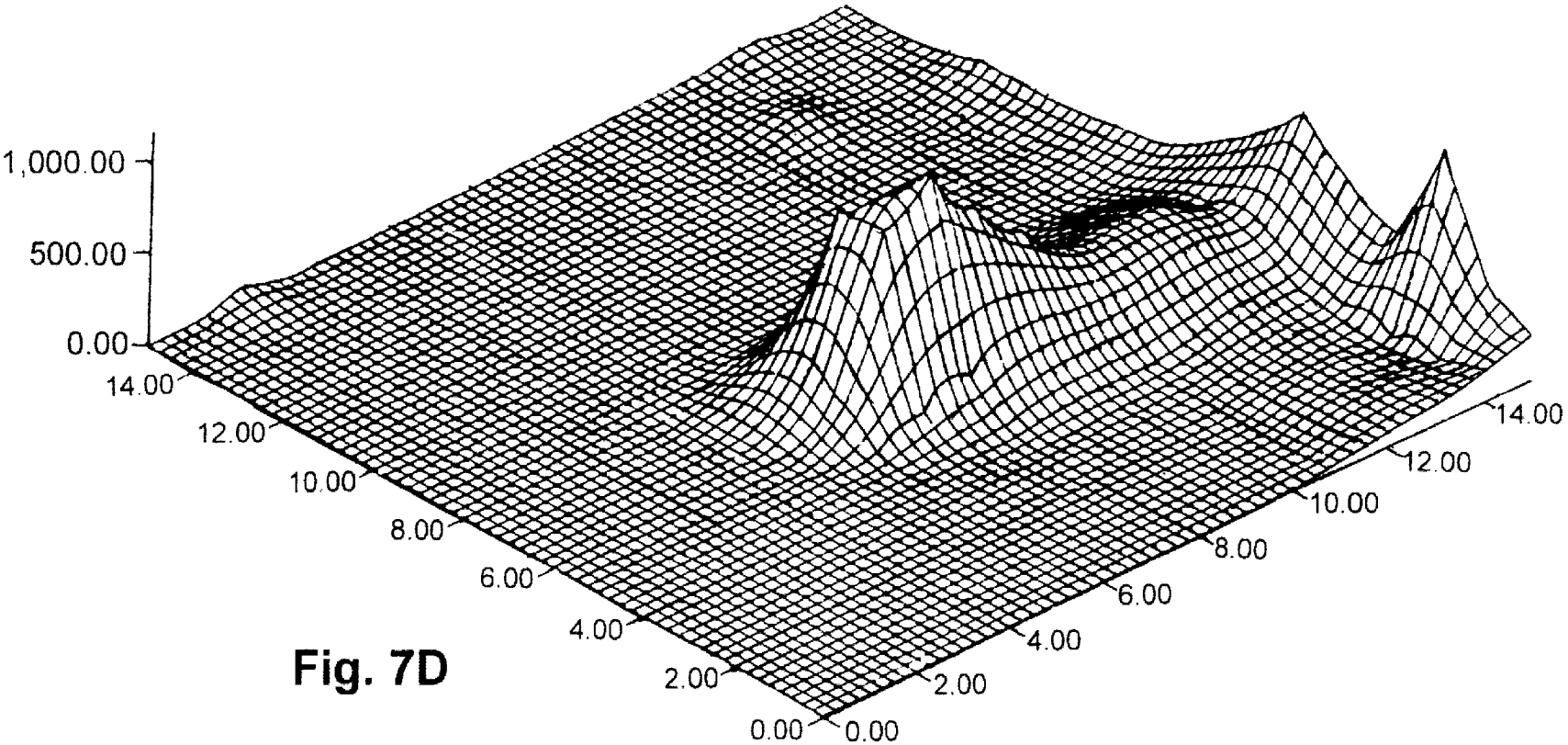

A second embodiment of the preferred invention is shown in FIG. 3. The injector 200 shown in FIG. 3 is the same as the injector 100 shown in FIG. 2, with the exception that the orifice 50 in FIG. 2 has been replaced with an orifice 500. The orifice 500 has a concave surface and at least one orifice opening 510.

In this embodiment, the orifice opening 510 is spaced from the longitudinal axis 106 a distance greater than half the diameter $D_2$ of the seat opening 340. In other words, the orifice opening 510 is located sufficiently far from the longitudinal axis 106 so that, in the longitudinal direction, the seat 30 overhangs or "shadows" the orifice opening 510. As the fuel flows through the seat opening 340 and past the seat 30, a lateral velocity component is imparted on the fuel. This lateral velocity component produces a fan shaped spray as the fuel passes through the orifice opening 510, without the need for an elliptical or a slotted orifice opening. The shadowing of the orifice opening 510 is also known as a "wall effect".

The effect of shadowing the orifice opening 510 on the injector dynamic mass flow rates is shown below in Table 1, shown in FIG. 5. The results of Table 1 represent experimental date for four bent stream fuel injectors. Injectors #1 and #2 have a seat opening 320 with a 1.4 mm diameter $D_1$, and injectors #3 and #4 have a seat opening 340 with a 1 mm seat diameter $D_2$.

It can be seen from the column labeled "SMD [$\mu$m]" in Table 1 that the orifice shadowing significantly reduces the size (SMD—Sauter Mean Diameter) of the spray particles without significantly reducing the dynamic flow of the fuel through the injectors. The Sauter mean diameter is an approximation of a mean size droplet in a spray. The approximation assumes that each droplet is spherically shaped and also assumes an equal area for each droplet. A corresponding set of spray pattern images, as shown in FIGS. 6A–D also shows that as compared to the fuel injector I1, I2 without the wall effect (Injectors #1 and #2 of Table 1), fuel injectors 13, 14 with the wall effect (Injectors #3 and #4 of Table 1) have a significantly smaller spray particle size and a larger fan shaped spray pattern. The similar fan type spray pattern can also be seen in the results as shown in the distribution patterns shown in FIGS. 7A–D. Injectors I1–I4 of FIGS. 6A–D, respectively, correspond to Injectors #1–4 in Table 1.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A method of generating turbulent flow in a fuel injector comprising:

providing a fuel injector having:

a longitudinal axis extending therethrough;

a needle located along the longitudinal axis;

a seat having a seating diameter and a seat opening having an opening diameter formed on a surface of the seat that extends perpendicularly, that is, at right angle to the longitudinal axis, the seat opening located downstream of the seating diameter, the needle engaging the seat at the seating diameter in a closed position; and a single metering plate located downstream of the seat and contiguous to the surface of the seat so as to form a chamber between the metering plate and the seat, the metering plate having an apex on the longitudinal axis so that a cross section of the metering plate is arcuate, the metering plate having at least one metering opening spaced at a distance transverse to the longitudinal axis, wherein the distance is greater than half of the opening diameter; and providing fuel through the injector.

2. The fuel injector according to claim 1, wherein the seat extends generally downstream and inward between the seating surface and the seat opening.

3. The fuel injector according to claim 2, wherein a diameter of the seat opening is between 1.67 millimeters and 1.68 millimeters.

4. The method according to claim 1, wherein providing fuel through the injector comprises:

providing fuel through the seat opening generally along the longitudinal axis; and directing the fuel through the at least one metering opening generally radially from the longitudinal axis.

5. The method according to claim 4, providing the fuel through the seat opening comprises generating a Reynolds number of at least 13,000.

6. A fuel injector comprising:

an upstream end;

a downstream end;

a longitudinal axis extending therethrough;

a body extending generally along the longitudinal axis between the upstream end and the downstream end;

a cylindrical needle reciprocably located within the body between an open configuration adapted for permitting delivery of fuel from the downstream end and a closed configuration adapted for preventing delivery of the fuel from the downstream end; and a seat disposed proximate the downstream end, the seat including:

a seating surface engageable with the needle when the needle is in the closed configuration, the seating surface having a seating diameter; and a seat opening having an opening diameter formed on a surface of the seat that extends perpendicular, that is, at right angle to the longitudinal axis, the seat opening located downstream of the seating diameter; and a single metering plate having a portion that is concave with respect to the surface of the seat so as to form a hollow chamber between the seat and the metering plate, the metering plate located downstream of the seat and having at least one metering opening spaced at a distance transverse to the longitudinal axis, wherein the distance is greater than half of the opening diameter.

7. The fuel injector according to claim 6, wherein a diameter of the seat opening is between 1.66 millimeters and 1.68 millimeters.

8. The fuel injector according to claim 6, wherein the at least one metering opening is generally circular.

9. The fuel injector according to claim 6, wherein a ratio of the seat opening diameter to the seating diameter is less than 0.6.

10. The fuel injector according to claim 6, wherein the seat extends generally downstream and inward between the sealing surface and the seat opening.

11. A method of generating a fan-shaped flow in a fuel injector comprising:

providing a fuel injector having:

an upstream end;

a downstream end;

a longitudinal axis extending therethrough between the upstream end and the downstream end;

a needle reciprocably located along the longitudinal axis;

a seat having a seating diameter and a seat opening downstream of the seating diameter and along the longitudinal axis, the seat opening having an opening diameter formed on a surface of the seat extending perpendicularly, that is, at right angle, to the longitudinal axis; and a single generally arcuate metering plate located downstream of the seat and contiguous to the surface so as to form a chamber between the seat and the metering plate, the metering plate having at least one metering opening spaced at a distance transverse to the longitudinal axis, wherein the distance is greater than half of the opening diameter; and providing fuel through the fuel injector.

12. The method according to claim 11, wherein providing fuel through the injector comprises:

providing fuel through the seat opening generally along the longitudinal axis; and directing the fuel through the at least one metering opening generally oblique from the longitudinal axis.

* * * * *